United States Patent [19]

Lerner

[11] 3,962,005

[45] June 8, 1976

[54] METHOD FOR ETCHING SHADOW MASK AND REGENERATING ETCHANT

[75] Inventor: Martin Lerner, River Forest, Ill.

[73] Assignee: Zenith Radio Corporation, Chicago, Ill.

[22] Filed: June 30, 1975

(Under Rule 47)

[21] Appl. No.: 591,735

[52] U.S. Cl. ..... 156/16; 134/10; 156/18; 156/19; 156/345

[51] Int. Cl.[2] ..... C23F 1/04

[58] Field of Search ..... 156/8, 16, 18, 19, 345; 134/10

[56] References Cited

UNITED STATES PATENTS

| | | | |
|---|---|---|---|
| 3,526,560 | 9/1970 | Thomas | 134/10 |
| 3,574,013 | 4/1971 | Frantzen | 156/8 |
| 3,775,202 | 11/1973 | Meek et al. | 156/19 |
| 3,880,685 | 4/1975 | Rehm et al. | 156/345 |

*Primary Examiner*—William A. Powell
*Assistant Examiner*—Brian J. Leitten
*Attorney, Agent, or Firm*—John R. Garrett

[57] ABSTRACT

This disclosure depicts a novel method of etching a shadow mask for a color television picture tube and in particular to a method of etching the steel substrate layer of a two layer shadow mask, wherein the first layer has been previously etched, and of reclaiming the used etchant. Ferric sulphate is used to etch the steel substrate layer, resulting in the generation of ferrous sulphate, a by-product of the chemical reaction of the ferric sulphate etchant and the steel substrate. The used etchant is reclaimed by reacting and mixing in a particular manner the used etchant with sulfuric acid and hydrogen peroxide.

3 Claims, 5 Drawing Figures

METHOD FOR ETCHING SHADOW MASK AND REGENERATING ETCHANT

BACKGROUND OF THE INVENTION

This invention relates in general to a method of etching a shadow mask, for a color television picture tube, and in particular to a method of etching the steel substrate layer of a two layer shadow mask, wherein the first layer has been previously etched, and of reclaiming the used etchant.

Conventionally, blanks for shadow masks for color television picture tubes, typically composed of 5–6 mil steel, have been etched with a ferric chloride etchant. Areas of the blank which are not to be etched are protected by a patterned layer of suitable photoresist. As the etching takes place, the spent ferric chloride etchant is regenerated by adding chlorine to the used etchant. Another etchant which may be used is ferric sulphate, however, this etchant is not commercially desirable since it is very expensive and much slower in its chemical milling action than ferric chloride.

This invention has general applicability to the etching of color CTR shadow masks, but is most advantageously applied to the etching of a novel color television picture tube shadow mask, details of which are disclosed in U.S. Pat. No. 3,794,873. This shadow mask is composed of two layers of different metals - a thin aperture-defining layer, preferably nickel, disposed on a substrate layer, preferably steel. Initially, a ferric chloride etchant may be used to etch a pattern of holes in the aperture-defining layer (here assumed to be composed of nickel) through an exposed and developed photoresist layer. However, to further etch through the steel substrate layer, an etchant which will not attack the nickel, but which will etch the steel, is needed. An etchant of ferric sulphate would meet the requirements for this application, however, prior to this invention it would be too expensive to use.

OBJECTS OF THE INVENTION

It is an object of this invention to provide an improved method for etching a color CRT shadow mask which has a steel substrate layer and an aperture-defining layer, and particularly an improved method of etching the substrate layer of such a mask with an etchant of ferric sulphate and of efficiently regenerating the etchant.

It is an object to drastically reduce, in the manufacture of color television picture tube shadow masks, the expense incurred by using ferric sulphate as a shadow mask etchant.

BRIEF DESCRIPTION OF THE DRAWINGS

The features of the present invention which are believed to be novel are set forth with particularly in the appended claims. The invention, together with further objects and advantages thereof, in conjunction with the accompanying drawings, in which:

FIG. 2 depicts normalized etch rate value as a function of ferric sulphate concentration; FIG. 3 is a graph of regeneration temperature as a function of efficiency; FIG. 4 is a graph of regeneration efficiency as a function of ferric sulphate concentration; and FIG. 5 is a graph of regeneration efficiency as a function of hydrogen peroxide concentration.

DESCRIPTION OF THE PREFERRED EMBODIMENT

Figure 1:
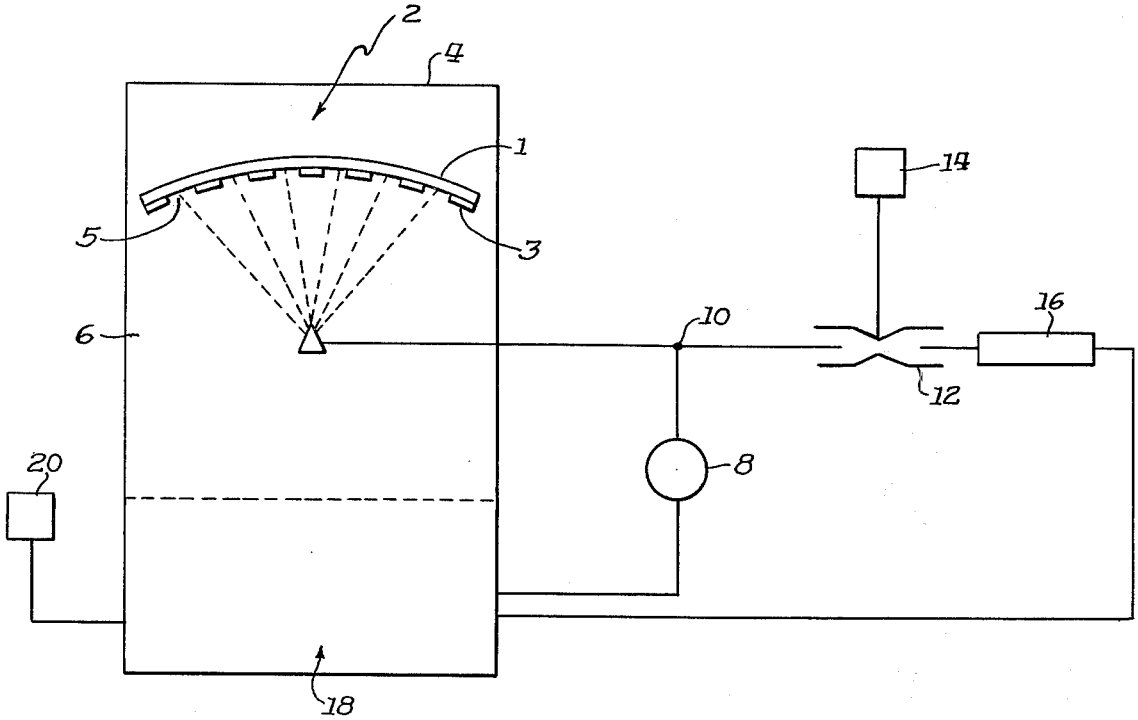
FIG. 1 schematically illustrates an apparatus useful for carrying out a method according to the present invention.

FIG. 1 schematically illustrates apparatus for implementing the method of the present invention. The apparatus is shown as including an etching unit 4 within which is located an etchant spray nozzle 6 for discharging an etchant onto the concave side of a curved color CRT shadow mask 2. The shadow mask 2 is described in detail and claimed in U.S. Pat. No. 3,794,873. The shadow mask 2 is composed of two layers of different metals, a first layer 3 being and electron aperture-defining layer composed of nickel or some other suitable metal. A substrate layer 1 is composed of steel.

In preparation for the method of the present invention the shadow mask blank is first formed into a curved shape aperture-defining layer on the concave side. A photoresist layer is applied to the aperture-defining and exposed through a suitable stencil, creating a pattern of apertures in the photoresist layer. The aperture-defining layer is etched through the apertures in the photoresist layer with ferric chloride until the substrate layer is reached. The etching is then stopped and the photoresist layer is removed. The resulting apertures 5 in the aperture-defining layer of the shadow mask serve two purposes. First, they define the effective mask apertures which are presented to the electron beam in the end-product color television picture tube, and second they act as an etchant resist in the etching of the steel substrate layer. It is desirable that no further etching of the aperture-defining layer take place. For ease of explanation, the aperture-defining layer will hereafter be assumed to be composed of nickel.

An appropriate etchant must be selected in order to etch the steel substrate layer 1 without substantially etching the pre-etched nickel layer 2. Ferric sulphate has been found to meet this requirement. When ferric sulphate is used to etch the steel substrate 1 of the shadow mask 2, the chemical reaction generates ferrous sulphate according to the following equation:

$$Fe + Fe_2(SO_4)_3 \quad 3FeSO_4$$

It is necessary to reclaim or regenerate the ferric sulphate from the ferrous sulphate since to use new ferric sulphate continuously would be prohibitively expensive and impractical. It is an aspect of this invention to efficiently regenerate the used ferric sulphate etchant. In order to reclaim the ferric sulphate, the ferrous sulphate is chemically reacted with sulfuric acid and hydrogen peroxide according to the following equation:

$$2\,FeSO_4 + H_2O_2 + H_2SO_4 \quad Fe_2(SO_4)_3 + 2H_2O$$

To carry out the method of this invention, the shadow mask 2 is inserted in etching unit 4 and nozzle 6 sprays the ferric sulphate etchant onto the shadow mask 2. A pump 8 directs the ferric sulphate etchant from a main reservoir 18 to the nozzle 6 for spraying onto the mask 2.

Sulfuric acid can be added at various points in the system, but is most advantageously added directly to the main reservoir 18 from a sulfuric acid reservoir 20.

As also can be seen from the regeneration equation, hydrogen peroxide is also added to the etchant solution. Tests have shown there are a number of requirements which, surprisingly, must be met in the addition of the hydrogen peroxide to the used etchant. First, it is necessary that there be thorough mixing for the chemical reaction to be efficient. Second, the used etchant must be prevented from backing up into the source of hydrogen peroxide to minimize the possibility of a violent chemical explosion. Third, since hydrogen peroxide rapidly decomposes upon exposure to the atmosphere, the mixing must be done in an air-free environment. Fourth, the hydrogen peroxide, being less dense than the used etchant will tend to float on it; it has been found to be desirable, therefore, to nullify the effect of gravity and thereby prevent the hydrogen peroxide from separating from the used etchant.

At point 10, (FIG. 1) a portion of the ferric sulphate etchant which also contains sulfuric acid and ferrous sulphate is tapped off. This portion of the used etchant is formed into a narrow negative pressure stream, causing the hydrogen peroxide to be sucked into the narrow stream. This effect is preferably achieved by the use of a venturi mixer, shown schematically at 12. This prevents the used etchant from backing up into a hydrogen peroxide reservoir 14 and is safer than other possible methods of adding the hydrogen peroxide.

The venturi mixer 12 is used to add the hydrogen peroxide and to effect reasonably thorough mixing of it with the used etchant. In addition, the venturi mixer with 12 fully confines the stream against the atmosphere (preventing reaction of the hydrogen peroxide with the atmosphere) and negates gravitational effects due to the fast moving narrow stream. After mixing has ocurred in the venturi, further mixing is preferably accomplished in line mixer 16.

In the venturi mixer 12 and the line mixer 16 a chemical reaction of the hydrogen peroxide and the sulfuric acid takes place with the ferrous sulphate to generate ferric sulphate which is then returned to the main reservoir 18.

In this manner ferrous sulphate is continuously and very efficiently regenerated back into ferric sulphate by the addition of hydrogen peroxide and sulfuric acid. Most importantly, it is the afore-described mixing action, preferably accomplished by the use of a venturi mixer, which enables the regeneration method to operate efficiently. After a predetermined amount of time the mask 2 is removed from the etching unit 4. This predetermined time has been established such that the holes will be etched all the way through the steel substrate layer 1.

Figure 2:
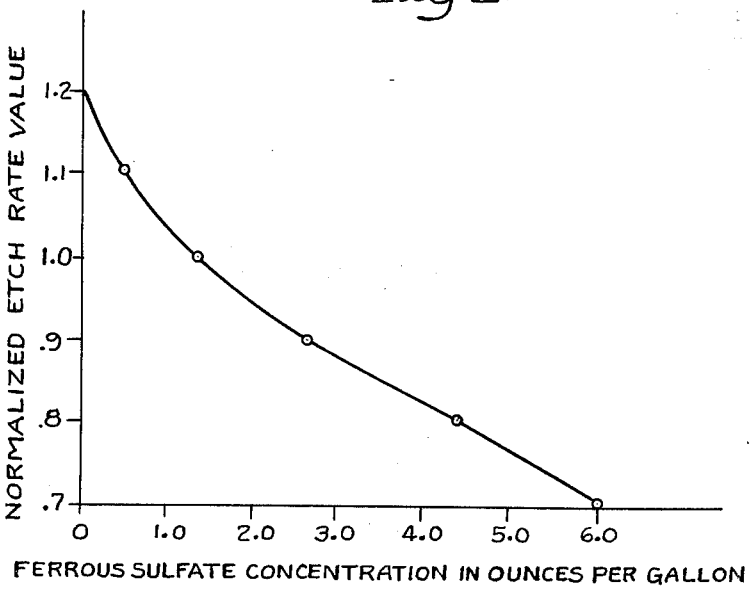
FIGS. 2–5 are graphs useful in understanding the present invention.

FIG. 2 shows a graph of the normalized etch rate value as a function of the ferrous sulphate concentration. The etch rate decreases as the ferrous sulphate concentration increases. It was found that a minimum acceptable etch rate value lies at approximately 1 ounce per gallon of ferrous sulphate.

Figure 3:
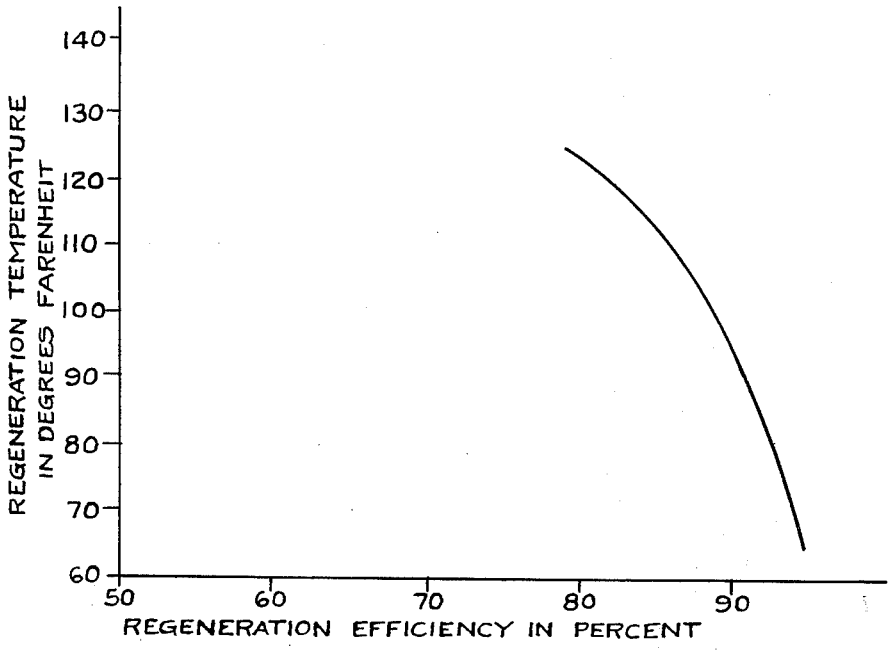

FIG. 3 shows the effect of temperature on efficiency of regeneration. As the temperature is increased the efficiency of regeneration decreases. The optimum temperature for regeneration was found to lie at about 80°. At this point the efficiency of regeneration of ferric sulphate is about 90%. However, during the etching process a temperature of 125°F was found to produce satisfactory results. Therefore, the ferric sulphate must be heated up to 125° from 80° for the etching process and then the solution of ferric sulphate and ferrous sulphate must be cooled to 80° for the regeneration process. This small change in temperature can be effected relatively inexpensively. However, to cool the regeneration process much lower would entail employing expensive refrigeration means and the increase in the percent of efficiency would be very small. Therefore, 80° was selected as an optimum value of temperature for regeneration.

Figure 4:
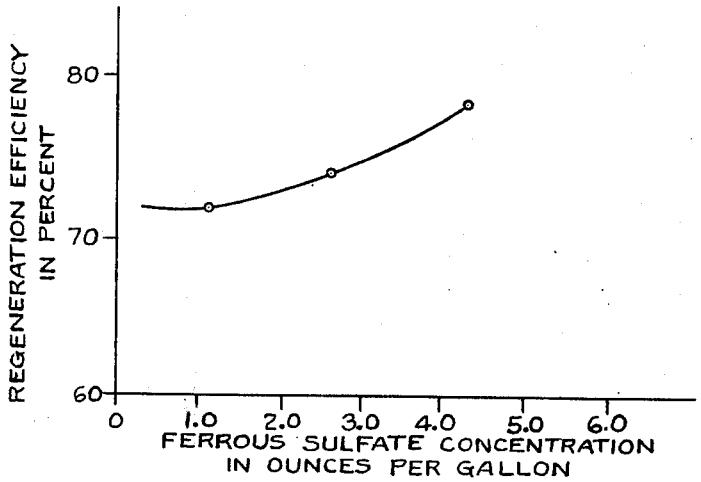

FIG. 4 indicates the regeneration efficiency for various concentrations of ferric sulphate. The curve is fairly linear and there is only a small change in regeneration efficiency with various concentrations of ferric sulphate. Therefore, the value of one ounce per gallon was found to produce good results for the etch rate value as indicated in FIG. 1 and the regeneration efficiency was not adversely affected by using this value.

Figure 5:
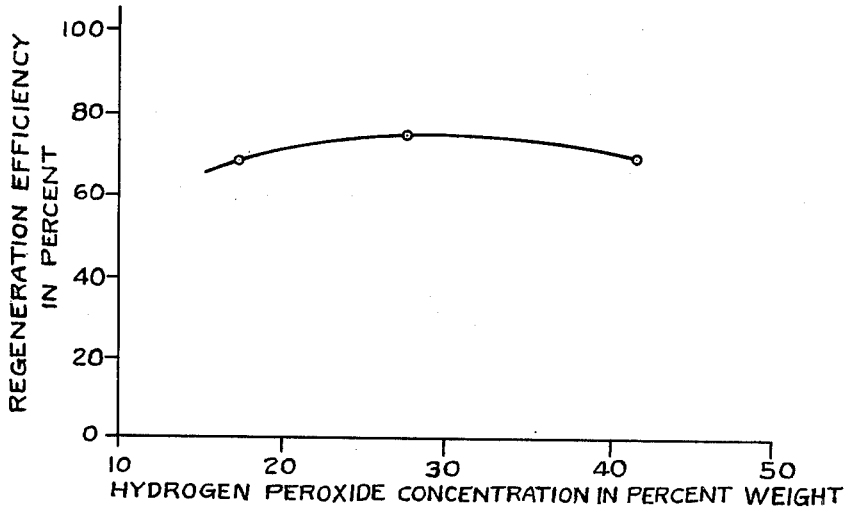

FIG. 5 shows the regeneration efficiency as a function of hydrogen peroxide concentration. Again there is only a small change in the regeneration efficiency for various concentrations of hydrogen peroxide. A value of 25% hydrogen peroxide concentration by weight was found to be convenient.

Tests have shown the following operating parameters have produced satisfactory results:

- concentration of hydrogen peroxide of 25% by weight,
- a flow rate of hydrogen peroxide of 24 cubic centimeters per minute,
- an etchant flow rate of 1 gallon per minute,
- an etching temperature during regeneration of 80°F,
- an iron regeneration per hour of 10.4 ounces,
- a ferrous concentration before regeneration of 0.67 ounces per gallon,
- a ferrous concentration after regeneration of 0.2 ounces per gallon, and
- sulfuric acid of approximately equal by weight in relation to the hydrogen peroxide.

The regeneration efficiency at 80°F has been found to be about 88% when a venturi mixer 12 is used, whereas other methods of adding the hydrogen peroxide (such as drop injection while stirring the ferrous sulphate) produced low efficiencies of only about 30% or 40%. Only with the method of using the venturi mixer was it found to be possible to achieve regeneration efficiencies high enough to make the use of ferric sulphate commercially attractive as a shadow mask etchant.

The invention is not limited to the particular details of construction of the method depicted and other modifications and applications are contemplated. Certain changes may be made in the above-described method without departing from the true spirit and scope of the invention herein involved. It is intended, therefore, that the subject matter in the above depiction shall be interpreted as illustrative and not in a limiting sense.

I claim:

1. In the manufacture of a color cathode ray tube shadow mask characterized by having a steel substrate layer and a thin aperture-defining layer, a method for etching a pattern of apertures in the substrate layer through a pattern of apertures preformed in the aperture-defining layer without substabtially further etching the aperture-defining layer, and for reclaiming the etchant employed, said method comprising, etching said substrate layer of said shadow mask through said pattern of apertures in said aperture-defining layer with a ferric sulphate etchant drawn from a main reservoir, said etching process being characterized by a reaction of said ferric sulphate forming a used etchant containing ferrous sulphate;

continuously removing a portion of said used etchant material;

efficiently regenerating said portion of said used etchant by adding to it sulfuric acid and hydrogen peroxide wherein said hydrogen peroxide is caused to be sucked from a source of hydrogen peroxide into a narrow stream of said portion of said used etchant to effect a mixing of said hydrogen peroxide with said used etchant without exposure of the etchant to the atmosphere, without the introduction of substantial gravitational effects, and without any risk of inducing a backflow of said used etchant material into the source of hydrogen peroxide; and returning the thus regenerated ferric sulphate formed from a chemical reaction of said ferrous sulphate, said sulfuric acid, and said hydrogen peroxide to the main reservoir.

2. The method as described in claim 1 wherein said ferrous sulphate, said hydrogen peroxide, and said sulfuric acid are further mixed after said hydrogen peroxide is sucked into said portion of said used etchant material.

3. The method defined by claim 1 wherein said hydrogen peroxide and said portion of used etchant material are mixed in a venturi device in which the relative flow rate of the hydrogen peroxide and the used etchant material is about 24 cubic centimeters of 25% hydrogen peroxide per gallon.

* * * * *